United States Patent [19]

Karino

[11] 4,364,355

[45] Dec. 21, 1982

[54] ELECTRONICALLY CONTROLLED FUEL SUPPLY APPARATUS FOR INTERNAL COMBUSTION ENGINE

[75] Inventor: Kimiji Karino, Katsuta, Japan

[73] Assignee: Hitachi, Ltd., Tokyo, Japan

[21] Appl. No.: 168,780

[22] Filed: Jul. 11, 1980

[30] Foreign Application Priority Data

Jul. 18, 1979 [JP] Japan ..... 54-90383

[51] Int. Cl.[3] ..... F02B 33/00

[52] U.S. Cl. ..... 123/438; 123/41.31; 123/541; 165/41; 165/51

[58] Field of Search ..... 123/41.31, 41.42, 438, 123/541, 478; 165/41, 51; 361/382, 386, 388, 389

[56] References Cited

U.S. PATENT DOCUMENTS 3,623,546 11/1971 Banthin ..... 165/51
3,628,516 12/1971 Perrin et al. ..... 123/541
3,669,082 6/1972 Hatz ..... 123/41.31
3,788,287 1/1974 Falen et al. .
3,931,814 1/1976 Rivere ..... 123/438
3,965,971 6/1976 Roggenkamp ..... 165/41
3,973,524 8/1976 Rubin ..... 123/41.42

FOREIGN PATENT DOCUMENTS 1123515 2/1962 Fed. Rep. of Germany ... 123/41.31
2823666 12/1979 Fed. Rep. of Germany ..... 361/382

*Primary Examiner*—P. S. Lall
*Attorney, Agent, or Firm*—Antonelli, Terry and Wands

[57] ABSTRACT

An electronically controlled fuel supply apparatus for controlling a fuel flow required by an internal combustion engine in dependence on operation parameters of the engine. An electronic control device is disposed within an engine chamber, and fuel is forcibly circulated in the vicinity of the electronic control device from a fuel tank to thereby cool the electronic control device.

9 Claims, 2 Drawing Figures

ELECTRONICALLY CONTROLLED FUEL SUPPLY APPARATUS FOR INTERNAL COMBUSTION ENGINE

BACKGROUND OF THE INVENTION

The present invention relates to an electronically controlled fuel supply apparatus for an internal combustion engine, wherein parameters representative of operating conditions of the engine are detected as electric signals which are then fed to an electronic control device to derive optimum quantity of fuel to be supplied to the engine, to thereby effect the fuel supply control on the basis of the derived value produced from the electronic control device.

At present, there is a great demand for a reduction of noxious components contained in the exhaust gas discharged from the internal combustion engine and a decrease in the fuel consumption of the engine.

In an effort to meet the demand, various electronic control devices have been developed for controlling electronically the quantity of fuel supplied to the internal combustion engine.

In general, the electronic fuel control device is implemented in a form of LSI (Large Scale Integrated) circuit. Since the upper limit of temperature at which such control circuit can be used effectively and reliably is relatively low, it is common in practice to install the fuel control device within a chamber of a motor car (e.g. driver's chamber). Consequently, a large number of signal transmission conductors of great length are required for establishing electric connection between the electronic fuel control device, on one hand, and the fuel supply device as well as various sensors which are installed in the vicinity of the internal combustion engine, on the other hand. The sensors of course serve to detect the parameters representing the operating conditions of the engine. It is obvious that the use of the signal conductors of great length is not preferable from many standpoints.

Recently, an attempt has been proposed to reduce the length of the signal conductors by mounting the electronic control device on a main body of the fuel supply apparatus, as is disclosed in U.S. Pat. No. 3,788,287.

However, when the electronic control device is to be mounted on the body of the fuel supply apparatus, the former has to be constructed by using electronic circuit elements or parts which exhibit high heat-resistance properties, involving increased manufacturing cost, because the fuel supply apparatus is thermally coupled to the engine through an intake manifold and is possibly subjected to a high temperature in the range of 80° C. to 100° C. particularly when the engine is operated at a high speed.

SUMMARY OF THE INVENTION

An object of the present invention is to provide an electronically controlled type fuel supply apparatus provided with an electronic control device which can inexpensively be manufactured and exhibits a high heat-resistance property.

Another object of the invention is to provide an electronically controlled fuel supply apparatus in which the electronic control device can be maintained at a substantially constant temperature.

According to an aspect of the invention, it is proposed that the electronic control device is installed in an engine chamber, wherein fuel contained in a fuel tank is caused to circulate in such manner that the electronic control device is directly or indirectly brought into contact with the fuel flow.

DESCRIPTION OF THE PREFERRED EMBODIMENTS

Figure 1:
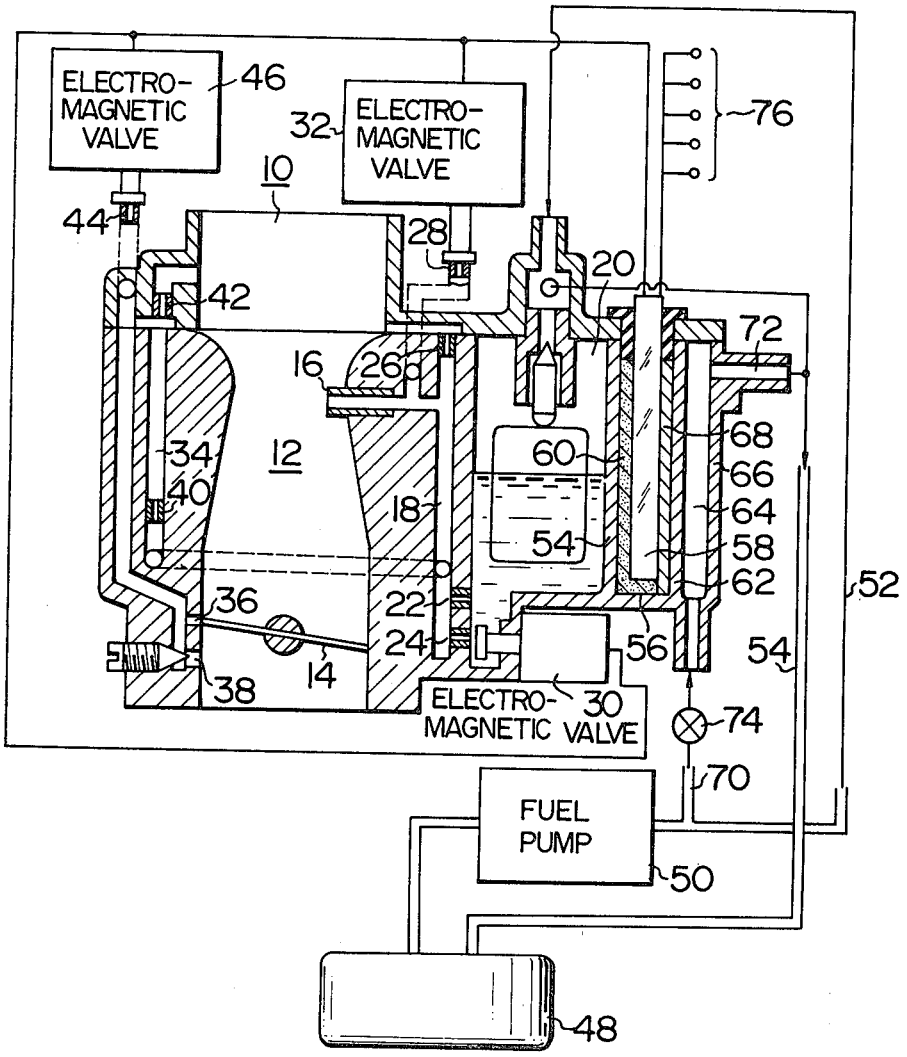
FIG. 1 shows schematically an arrangement of an electronically controlled fuel supply apparatus according to an embodiment of the invention.

FIG. 1 illustrates an electronically controlled fuel supply apparatus which is operative with a carburetor.

Referring to the figure, there is disposed in an air suction passage 12 of a carburetor 10 a throttle valve 14 which is adapted to meter an air flow. Projecting and opened in the air suction passage 12 upstream of the throttle valve 14 is a main nozzle 16 which is communicated to a float chamber 20 through a main fuel passage 18 which, in turn, is provided with a main jet orifice 22, an auxiliary main jet orifice 24, a main air bleed orifice 26 and an auxiliary main air bleed orifice 28. The auxiliary main jet orifice 24 and the auxiliary main air bleed orifice 28 are associated with electromagnetic valves 30 and 32, respectively. On the other hand, a slow fuel passage 34, branched from the main fuel passage 18 at an intermediate portion thereof, is opened in the air suction passage 12 in the vicinity of the throttle valve 14 through a bypass port 36 and an idle port 38. The slow fuel passage 34 is provided with a slow jet orifice 40, a slow air bleed orifice 42 and an auxiliary slow air bleed orifice 44 on the way to the air suction passage 12. The auxiliary slow air bleed 44 has an electromagnetic valve 46 associated therewith. The electromagnetic valves 30, 32 and 46 are selectively operated in an opening or closing direction under command of a control pulse signal, to thereby control the respective fuel flows. The control pulse signal is supplied from the electronic control device which will hereinafter be described.

The carburetor has a float chamber 20 to which fuel is supplied from a fuel tank 48 through a pipe 52 by means of a fuel pump 50. A part of the fuel is fed back to the fuel tank 48 through a return pipe 54.

The arrangement of the electronically controlled carburetor described above is at present adopted in practice.

According to the teaching of the invention, the electronically controlled fuel supply apparatus is constructed in a manner described below.

Referring again to FIG. 1, a container box 56 is formed integrally with an outer wall 54 constituting a part of the enclosure of the float chamber 20 and is adapted to accommodate therein the electronic control device 58. A thermal insulation layer 60 is interposed between the electronic control device 58 and the outer wall 54 of the float chamber 20 with a view to suppressing heat transmission to the electronic control device 58 from the float chamber 20.

Further, a fuel circulating chamber 64 is formed at an outer wall 68 of the container box 56 in cooperation with a wall 66 of the fuel circulating chamber 64. The electronic control device 58 is thermally coupled to the wall 62 of the container box 56 through a heat conducting layer 68. The fuel circulating chamber 64 is connected to the fuel pump 50 through a pipe 70, on one hand and connected to the return pipe 54 through a pipe 72, on the other hand, so that the fuel can flow through the fuel circulating chamber 64 from the fuel tank 48. The pipe 70 is provided with a temperature responsive valve 74 on the way to the fuel pump 50, which valve 74 is adapted to block the pipe 70 when the temperature in the fuel circulating chamber 64 is not higher than a predetermined temperature level or value. To this end, the temperature responsive valve 74 is electrically linked to the fuel pump 50 through the electronic control device 58.

The electronic control device 58 is supplied with signals output from various sensors (generally denoted by reference numeral 76) which are adapted to detect parameters representative of operating conditions of the engine and electronic control device sends control pulses to the electromagnetic valves 30, 32 and 46 in response to the input signals from the sensors.

With the arrangement described above, when the engine is started and the motor vehicle is in the running state, the electronic control device 58 effects predetermined operations to thereby actuate the electromagnetic valves 30, 32 and 46 so that an optimum quantity of fuel can be supplied to the engine. At that time, the fuel pump 50 is of course operated, as the result of which the fuel from the fuel tank 48 is fed to the fuel circulating chamber 64 through the pipe 70 to thereby cool the electronic control device 58 and is then returned to the fuel tank 48 through the pipes 72 and 74.

Usually, the temperature of the carburetor 10 will be increased to a level in the range of 80° C. to 90° C. during high speed operation, whereby the electronic control device 58 undergoes adverse influence of such high temperature. However, according to the invention, the electronic control device 58 can remain at a low temperature by virtue of the arrangement that the fuel within the fuel tank 48 which is usually at a temperature of 30° C. to 50° C. is caused to flow in the vicinity of the electronic control device 58.

When the motor vehicle is stopped after operation, the operation of the fuel pump 50 would be stopped in the case of the conventional fuel supply system. However, according to the invention, the temperature responsive valve 74 will then detect the current temperature of the electronic control device and supplies a signal representing the detected temperature to the electronic control device 58. When the detected temperature is higher than the predetermined one, the fuel pump 50 continues to be driven, while the pipe 70 is communicated with the fuel circulating chamber 64, whereby the fuel is continuously circulated through the fuel circulating chamber 64 from the fuel tank 48 to cool the electronic control device.

In the case of the embodiment illustrated in FIG. 1, the electronic control device is directly mounted on the carburetor. It goes without saying, however, that the electronic control device may equally be mounted in a throttle chamber of an injection type fuel supply apparatus. In the latter case, the electronic control device is also cooled by the fuel circulated from the fuel tank.

Figure 2:
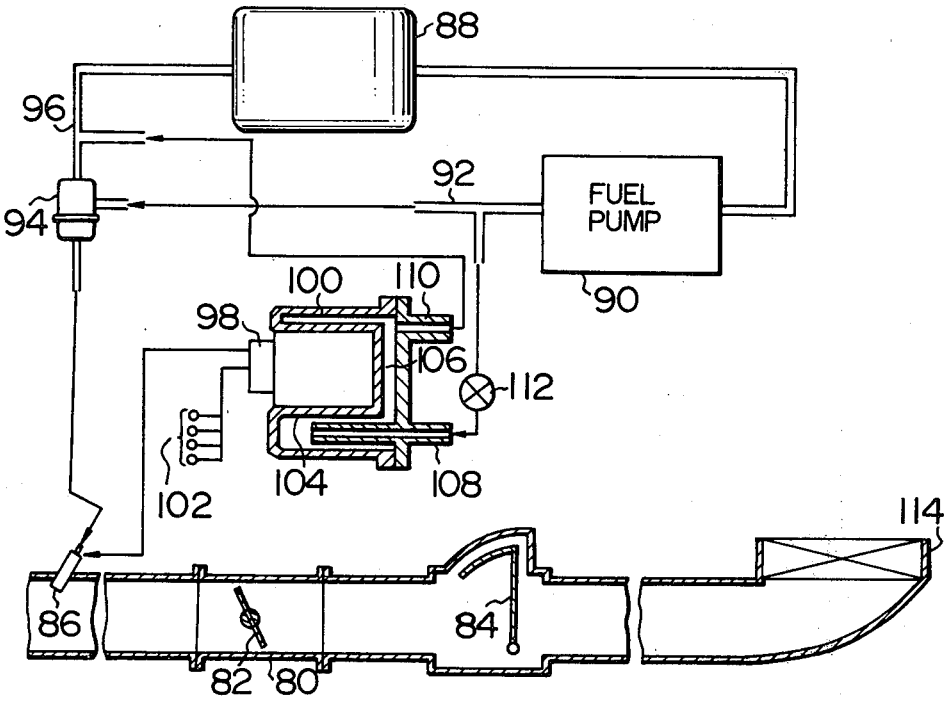
FIG. 2 shows schematically an arrangement of the electronically controlled fuel supply apparatus according to another embodiment of the invention.

Next, another exemplary embodiment of the invention will be described by referring to FIG. 2 which shows a fuel supply apparatus of a fuel injection type.

Referring to this figure, there is provided a throttle valve 82 in a throttle chamber 80 which represents typically the engine intake system. An air flow meter 84 is disposed upstream of the throttle chamber 80, while an injector 86 is disposed downstream of the throttle chamber 80. The injector 86 is supplied with fuel from a fuel tank 88 through a pipe 92 by means of a fuel pump 90. A pressure regulator 94 is interposed between the fuel pump 90 and the injector 86 to thereby control the pressure at the injector 86 to be substantially constant. The pressure regulator 94 and the fuel tank 88 are communicated to each other through a return pipe 96.

An electronic control device 98 is accommodated within a container box 100 which is provided separately from the intake or suction system. The electronic control device 98 receives signals representative of operating conditions of the engine from associated sensors 102 and sends a control pulse to the injector 86 in dependence on the input signals from the sensors.

A fuel circulating chamber 106 is formed in the container box 100 so that the electronic control device 98 is thermally coupled to the chamber 106 through a heat conducting member 104. The fuel circulating chamber 106 is connected, on the one hand, to the fuel pump 90 through a pipe 108 and, on the other hand, communicated to the return pipe 96 through a pipe 110. A temperature responsive valve 112, having the same function as that of the valve 74 shown in FIG. 1, is disposed in the pipe 108 at an intermediate portion thereof.

In principle, the container box 100 accommodating therein the electronic control device 98 is only required to be installed within the engine chamber and may be mounted on an air cleaner 114, for example.

Upon operation of the engine, the fuel pump 90 is actuated, whereby the fuel is fed to the fuel circulating chamber 106 from the fuel tank 88 through the pipe 108 to thereby cool the electronic control device 98. The fuel to which heat is transferred from the fuel circulating chamber 106 is fed to the return pipe 96 through the pipe 110 to be returned to the fuel tank 88. When the motor vehicle is stopped, operation of the temperature responsive valve 112 similar to that of the valve 74 described hereinbefore in conjunction with FIG. 1 will take place.

The electronically controlled fuel supply apparatus according to the invention which is typically exemplified by the embodiments illustrated in FIGS. 1 and 2 brings about advantageous actions and effects described below:

(1) By virtue of the arrangement that the electronic control device is disposed within the engine chamber, the length of the signal conductors extending between the electronic control device and the sensors for detecting the engine operation parameters as well as the fuel control means (e.g. electromagnetic valves and injector) can be reduced significantly. Further, because the electronic control device is forcibly cooled by the fuel circulated from the fuel tank, those parts or circuit elements which constitute the electronic control device can be selected without taking into consideration the heat-resistance thereof, allowing thus the electronic control device to be implemented inexpensively.

(2) Since the electronic control device is cooled by the fuel supplied from the fuel tank and having a substantially constant temperature, variations in the characteristics of the electronic components of the control device which are ascribable to temperature variation can be substantially obviated.

I claim:

1. An electronically controlled fuel supply apparatus for an internal combustion engine, comprising: sensors for deriving operation parameters of said engine in the form of electric signals; electronic control means for deriving a quantity of fuel to be supplied to said engine on the basis of the input signals produced from said sensors; fuel supply means for controlling accurately the fuel quantity in dependence on a signal produced from said electronic control means and representing the fuel quantity to be supplied to the engine, the fuel supply means including fuel injection means; a fuel tank from which the fuel is supplied to said fuel supply means; a container for accommodating therein said electronic control means; a fuel circulating chamber formed integrally with said container; first and second pipes for communicating said fuel circulating chambers and said fuel tank to each other; a fuel pump disposed in said first pipe at an intermediate portion thereof; and a temperature responsive valve disposed in either said first or second pipe, said temperature responsive valve being adapted to be closed when temperature of said electronic control means is not higher than a predetermined temperature value.

2. An electronically controlled fuel supply apparatus for an internal combustion engine, comprising: sensors for deriving operation parameters of said engine in a form of electric signals; electronic control means for deriving a quantity of fuel to be supplied to said engine on the basis of the input signals produced from said sensors; fuel supply means for controlling accurately the fuel quantity in dependence on a signal produced from said electronic control means and representing the fuel quantity to be supplied to the engine; a fuel tank from which the fuel is supplied to said fuel supply means; a container combined integrally with said fuel supply means and adapted to contain therein said electronic control means; a fuel circulating chamber formed integrally with said container; first and second pipes for communicating said fuel circulating chambers and said fuel tank to each other; a fuel pump disposed in said first pipe at an intermediate portion thereof; and a temperature responsive valve is disposed in either said first or second pipe, said temperature responsive valve being adapted to be closed when temperature of said electronic control means is not higher than a predetermined temperature value.

3. An electronically controlled fuel supply apparatus according to claim 2, wherein said fuel pump is adapted to operate only when said temperature responsive valve is opened.

4. An electronically controlled fuel supply apparatus for an internal combustion engine, comprising:

(a) an air suction passage;
(b) a throttle valve provided within said air suction passage;
(c) a main nozzle opened at the upward stream of said throttle valve for supplying fuel in accordance with a pressure reduction of air through said air suction passage;
(d) a float chamber integrally formed with a body forming said air suction passage for supplying the fuel to said main nozzle;
(e) an idle port opened at the downstream of said throttle valve and connected to said float chamber;
(f) a first electromagnetic valve for controlling the amount of fuel supplied from said main nozzle;
(g) a second electromagnetic valve for controlling the amount of fuel supplied from said idle port;
(h) a container box formed on said body;
(i) an electronic control device received in said container box for providing control signals to said first and second electromagnetic valves on the basis of input signals from sensors detecting operation parameters of said engine as electric signals;
(j) a fuel circulating chamber mounted in contact with said container box;
(k) a return pipe and pipe for connecting said fuel circulating chamber and a fuel tank; and
(l) a fuel pump disposed at intermediate portion in said pipe.

5. An electronically controlled fuel supply apparatus according to claim 4, wherein a temperature responsive valve is provided at intermediate portion of said pipe for connecting said fuel circulating chamber and said fuel pump, said valve being closed at the temperature below a predetermined temperature.

6. An electronically controlled fuel supply apparatus according to claim 4, wherein said container box is disposed in contact with and outside of said float chamber.

7. An electronically controlled fuel supply apparatus according to claim 6, wherein a thermal insulation layer is disposed at a space within said container box between said float chamber and said electronic control device.

8. An electronically controlled fuel supply apparatus according to claim 7, wherein said fuel pump is still actuated under the condition that said engine is stopped and said thermal responsive valve is opened.

9. An electronically controlled fuel supply apparatus for an internal combustion engine, comprising:

(a) an air suction passage;
(b) a throttle valve provided within said air suction passage;
(c) fuel supply means for supplying fuel to said air suction passage in accordance with the rate of air flow through said air suction passage;
(d) a container box formed on a body forming said air suction passage;
(e) an electronic control device received within said container box for generating control signals for controlling fuel supplied from said fuel supply means, in accordance with the input signals from sensors detecting the operation parameters of said engine as an electric signal;
(f) a fuel circulating chamber mounted in contact with said container box;
(g) a return pipe and pipe for connecting said fuel circulating chamber and a fuel tank; and
(h) a fuel pump disposed at intermediate portion of said pipe.

* * * * *